US009499978B2

(12) United States Patent
Glancy

(10) Patent No.: US 9,499,978 B2
(45) Date of Patent: Nov. 22, 2016

(54) BUILDING WALL PANEL

(71) Applicant: Kingspan Insulated Panels, Inc. (USA), Deland, FL (US)

(72) Inventor: Brian Glancy, Toronto (CA)

(73) Assignee: Kingspan Insulated Panels, Inc., Deland, FL (US)

( * ) Notice: Subject to any disclaimer, the term of this patent is extended or adjusted under 35 U.S.C. 154(b) by 0 days.

(21) Appl. No.: 14/044,266

(22) Filed: Oct. 2, 2013

(65) Prior Publication Data

US 2014/0090323 A1 Apr. 3, 2014

Related U.S. Application Data

(60) Provisional application No. 61/709,322, filed on Oct. 3, 2012.

(51) Int. Cl.

| | |
|---|---|
| ***E04C 2/20*** | (2006.01) |
| ***E04C 2/22*** | (2006.01) |
| ***E04C 2/38*** | (2006.01) |
| ***E04B 2/56*** | (2006.01) |
| ***E04C 2/292*** | (2006.01) |
| ***E04F 13/08*** | (2006.01) |
| ***E04F 13/12*** | (2006.01) |

(52) U.S. Cl.

CPC ..... *E04B 2/562* (2013.01); *E04C 2/205* (2013.01); *E04C 2/22* (2013.01); *E04C 2/292* (2013.01); *E04C 2/384* (2013.01); *E04F 13/0817* (2013.01); *E04F 13/0876* (2013.01); *E04F 13/12* (2013.01)

(58) Field of Classification Search

CPC ..... E04C 2/292; E04C 2/384; E04C 2/22; E04C 2/205

USPC ..... 52/235, 302.1, 302.4, 309.4, 309.7, 52/309.8, 309.9, 309.14, 404.4, 589.1, 52/592.1

See application file for complete search history.

(56) References Cited

U.S. PATENT DOCUMENTS

| | | | | |
|---|---|---|---|---|
| 3,300,934 A | | 1/1967 | Waizenhofer | |
| 3,310,926 A | * | 3/1967 | Brandreth et al. | 52/481.1 |
| 3,324,617 A | | 6/1967 | Knight et al. | |
| 3,438,168 A | | 4/1969 | Tischuk | |
| 3,474,583 A | | 10/1969 | Manias | |
| 3,522,683 A | | 8/1970 | Wise | |
| 3,667,180 A | | 6/1972 | Tischuk | |
| 3,678,642 A | | 7/1972 | Scott | |
| 3,760,548 A | * | 9/1973 | Sauer | E04B 1/6179 52/309.11 |
| 3,998,016 A | | 12/1976 | Ting | |
| 4,133,158 A | | 1/1979 | Ting | |

(Continued)

FOREIGN PATENT DOCUMENTS

| | | | | |
|---|---|---|---|---|
| EP | 1 179 645 | | 10/2005 | |
| GB | 2135708 A | * | 9/1984 | B32B 5/18 |

(Continued)

*Primary Examiner* — Ryan Kwiecinski

(74) *Attorney, Agent, or Firm* — Harness, Dickey & Pierce, P.L.C.

(57) ABSTRACT

A building wall panel has an outer skin, an inner skin and a foam insulated material sandwiched between the inner and outer skin. The panel defines a pair of edges between the front and back sides of the panel. A rail is positioned in the foam insulating material adjacent the outer skin near one of the edges. The rail enables securement of a façade to the panel.

14 Claims, 5 Drawing Sheets

(56) References Cited

U.S. PATENT DOCUMENTS

| | | | | |
|---|---|---|---|---|
| 4,250,678 | A | 2/1981 | Skuran | |
| 4,641,468 | A * | 2/1987 | Slater | E04B 1/12 52/309.4 |
| 4,700,520 | A | 10/1987 | Ting | |
| 4,866,896 | A | 9/1989 | Shreiner et al. | |
| 4,936,078 | A | 6/1990 | Porter | |
| 5,220,759 | A | 6/1993 | Hossli | |
| 5,373,678 | A * | 12/1994 | Hesser | E04C 2/292 52/309.2 |
| 5,425,210 | A | 6/1995 | Zafir | |
| 5,544,461 | A | 8/1996 | Sommerstein | |
| 5,638,651 | A * | 6/1997 | Ford | E04C 2/246 52/265 |
| 5,678,369 | A * | 10/1997 | Ishikawa et al. | 52/309.9 |
| 5,749,282 | A | 5/1998 | Brow et al. | |
| 5,956,910 | A | 9/1999 | Sommerstein et al. | |
| 6,070,382 | A | 6/2000 | Ettema | |
| 6,202,377 | B1 | 3/2001 | Krieger | |
| 6,226,947 | B1 | 5/2001 | Bado et al. | |
| 6,253,511 | B1 | 7/2001 | Boyer | |
| 6,279,287 | B1 | 8/2001 | Meadows | |
| 6,470,647 | B2 | 10/2002 | Hsueh | |
| 6,564,521 | B1 * | 5/2003 | Brown | E04C 2/296 52/309.11 |
| 6,895,721 | B2 | 5/2005 | Watanabe et al. | |
| 7,526,903 | B2 * | 5/2009 | Kandasamy | 52/782.1 |
| 7,748,181 | B1 | 7/2010 | Guinn | |
| 8,029,880 | B2 * | 10/2011 | Liu | E04B 5/12 428/33 |
| 8,327,593 | B2 * | 12/2012 | Laprise | E04B 1/14 52/284 |
| 2004/0010998 | A1 | 1/2004 | Turco | |
| 2004/0216416 | A1 | 11/2004 | Hohmann et al. | |
| 2005/0210800 | A1 | 9/2005 | Wobber | |
| 2006/0037282 | A1 | 2/2006 | Layfield | |
| 2006/0117689 | A1 * | 6/2006 | Onken | E04C 2/22 52/309.7 |
| 2007/0022682 | A1 | 2/2007 | Morgenegg et al. | |
| 2008/0083180 | A1 * | 4/2008 | Miller | E04B 1/14 52/309.4 |
| 2008/0127586 | A1 | 6/2008 | Carolan | |
| 2010/0170173 | A1 | 7/2010 | Boyer et al. | |
| 2010/0205883 | A1 | 8/2010 | Carson | |
| 2010/0229484 | A1 | 9/2010 | Carolan et al. | |
| 2010/0263314 | A1 | 10/2010 | MacDonald et al. | |
| 2012/0216471 | A1 | 8/2012 | Manser | |

FOREIGN PATENT DOCUMENTS

| | | |
|---|---|---|
| GB | 2 313 389 | 11/1997 |
| JP | 2005-90137 | 4/2005 |
| WO | WO96/24734 | 8/1996 |
| WO | WO2004/101907 | 11/2004 |

* cited by examiner

BUILDING WALL PANEL

CROSS-REFERENCE TO RELATED APPLICATION

This application claims the benefit of U.S. Provisional Application No. 61/709,322, filed on Oct. 3, 2012. The entire disclosure of the above application is incorporated herein by reference.

FIELD

The present disclosure relates to building materials and, more particularly, to a building wall panel.

BACKGROUND

Various types of building wall systems exist in the art. Ordinarily, a building wall system includes a framing structure, insulated portion and a façade portion. A mechanism secures the façade portion to the insulated portion. In commercial structures, the insulation is generally formed by a plurality of architectural panels that are secured to one another. Various types of mechanisms secure the façade to the architectural panels. Ordinarily, the panels include a front and rear metallic skin that sandwich an exterior foam insulating material. The insulating foam material is adhesively bonded or the like with the metallic skin to form the panels. The panels range in thickness from 1 inch to 6 inches or more and have a length anywhere from 6 feet to 60 feet long. Additionally, the width of the panels varies from 1 foot to about 5 feet. Thus, a wall or roof can be positioned onto the framing structure to rapidly enclose a building.

It is desirable to attached or hang the façade onto the panels. When hanging the façade, it is desirable to provide a rigid surface for attachment of the façade.

The present disclosure provides the art with a building wall panel that overcomes the disadvantages of the prior art. The present building wall panel provides a rigid surface to secure the façade.

SUMMARY

According to one aspect of the disclosure, a building wall panel comprises an outer skin, an inner skin, and a foam insulating material. The outer skin forms a front side of the building wall panel. The inner skin forms a rear side of the building panel. The foam insulated material is positioned between the inner and outer skins. A pair of edges is formed on the panel between the front and back sides. The edges interlock with adjacent panels. A rail is positioned in the foam insulating material adjacent to the outer skin. Additionally, the rail is near one of the pair of edges. The rail enables securement of a façade to the panel. One edge is a projecting edge and the other edge is a receiving edge. The rail includes at least one step for mating with at least one step of the outer skin. The rail is adhered to an inner side of the outer skin. The rail is positioned only on the front side of the building panel. The rail is bonded with an inner side of the outer skin.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
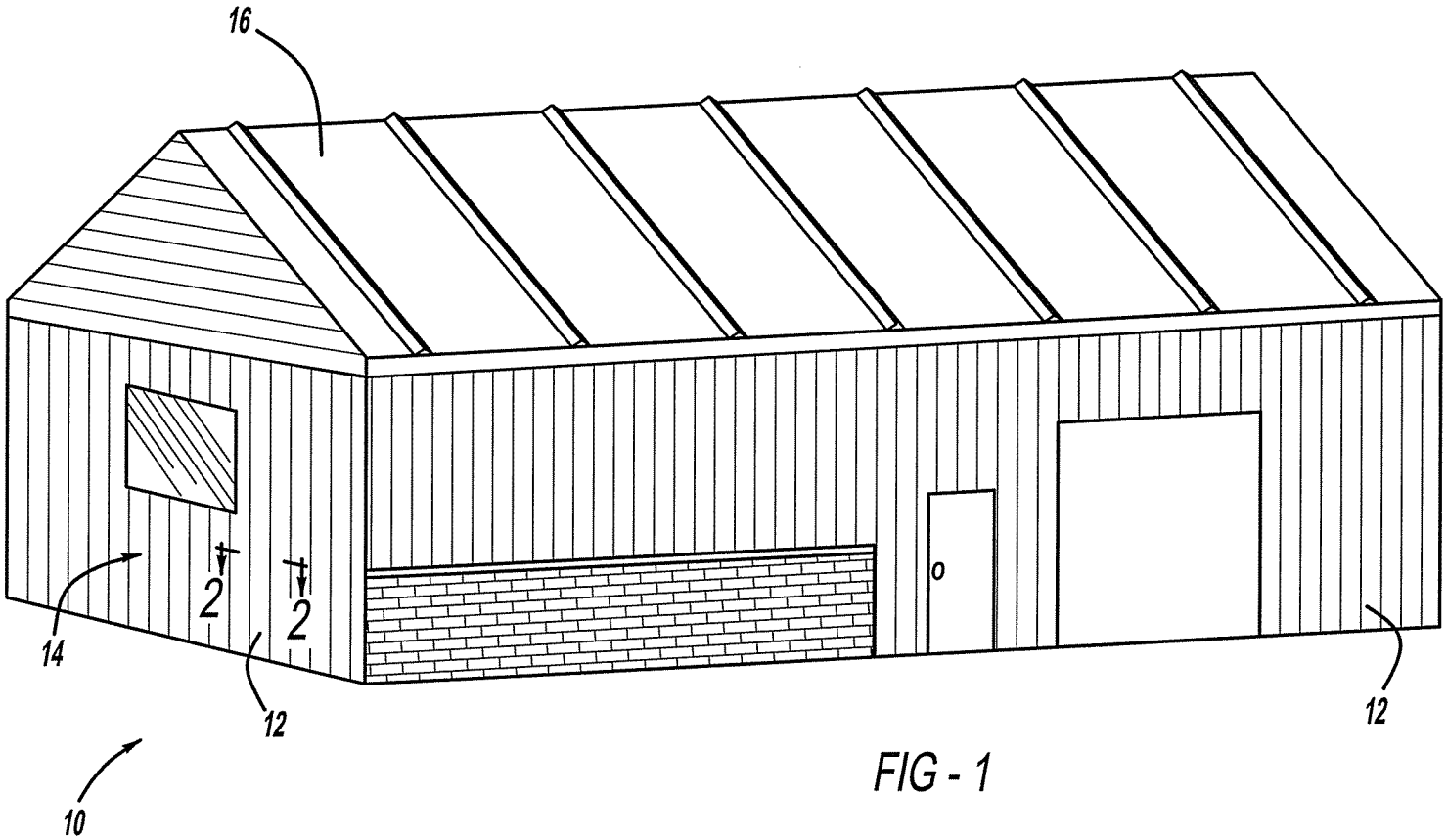
FIG. 1 is a perspective view of a building.

Turning to the figures, FIG. 1 illustrates a perspective view of a building. The building 10 includes walls 12 that include an outer façade 14. The building generally has a roof 16 and a framing structure 18 on which the walls are secured.

Figure 2:
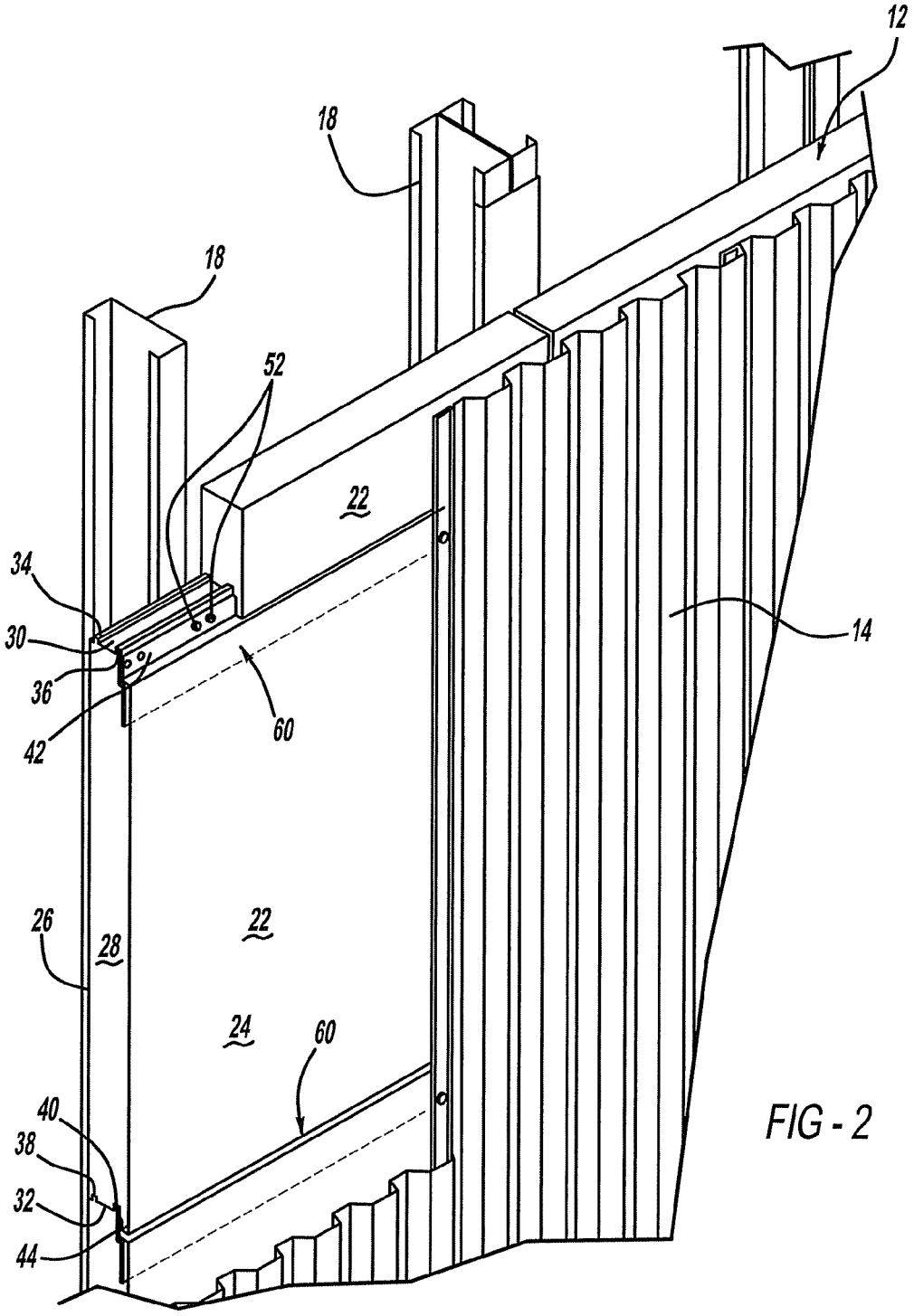
FIG. 2 is a perspective view partially in section of a wall with horizontal panels.
Figure 3:
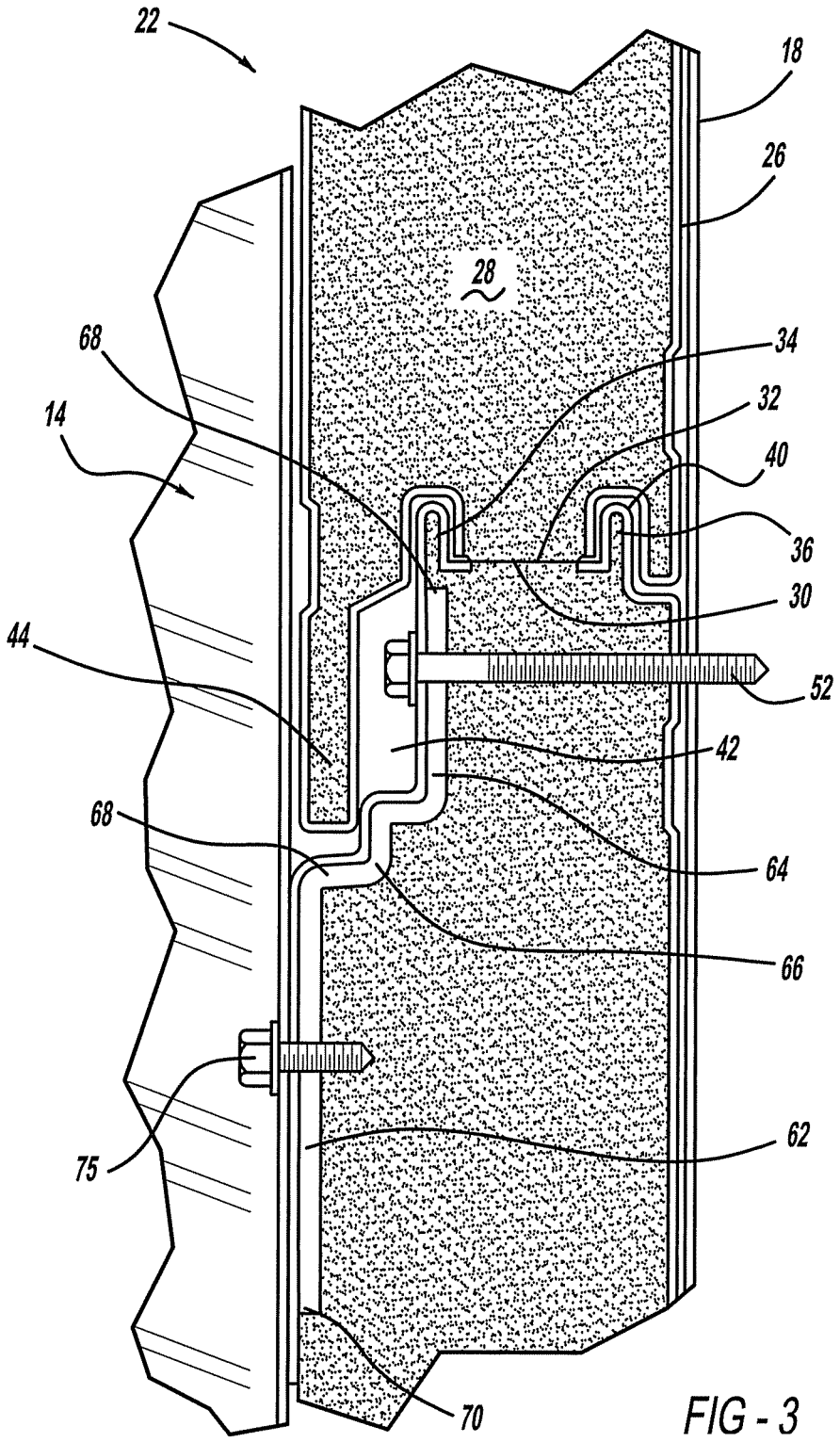
FIG. 3 is a cross-section view of FIG. 2.

Turning to FIG. 2, a breakaway of the wall is illustrated. The wall 12 includes a façade 14 as well as a plurality of insulated panels 22. The panels 22 generally include an outer skin 24, an inner skin 26 and foam insulating material 28 positioned between the two. The panels are manufactured such that the outer and inner skins 24, 26 are secured with the foam insulation 28. Also, each panel 22 includes edges 30, 32. Edges 30, 32 mate with other panels having an opposite edge as illustrated in FIG. 2. In FIG. 2, the edge 30 has a pair of projections 34, 36 extending from the edge 30. The edge 32 includes a pair of recesses 38, 40 to receive the projections 34, 36. Also, the edge 30 includes a cut-out 42 while the edge 32 includes a flange 44 that fits into the cut-out 42 as best seen in FIG. 3. As can be seen in FIG. 2, the panels are stacked one on top of the other in a horizontal arrangement or configuration. Additionally, the panels can be positioned side by side in a vertical arrangement. The panels are the same; however, the orientation is changed. The panels 22 are secured to the framing structure 18 via fasteners 52. The fasteners 52 secure to the framing structure 18 along the length of the building.

Internal rails 60 are positioned inside of the panel 22. The rails 60 are generally stamped to follow the contour of the area below edge 30 of outer skin 24. The rails 60 run the length of the panel 22 and include a body 62. Alternatively, the rail could be discontinuous and include portions of the rail spanning the length of the panel 22. The body 62 extends from the panel edge 30 a desired distance toward edge 32. As illustrated, the rails 60 include a pair of steps 64, 66. The step 66 coincides with the cut-out 42. The top end 68 of the rail 60 extends toward the projection 34. The other end 70 of the rail 60 is positioned a desired distance from the cut-out portion 42. The rail 60 is bonded or adhered to the outer skin 24. Additionally, the foam material 28 surrounds the backside of the rail 60 as seen in FIG. 3. Further, the rail could span between the inner and outer skins to provide structural support for the panel 22.

The rail 60 has a desired thickness enabling fasteners to pass through the rail 60 to secure a façade 14 with the rail 60. The rail 60 provides sufficient rigidity to enable the fasteners, which secure the façade, to pass through the rail 60 and provide a satisfactory anchoring system.

Figure 4:
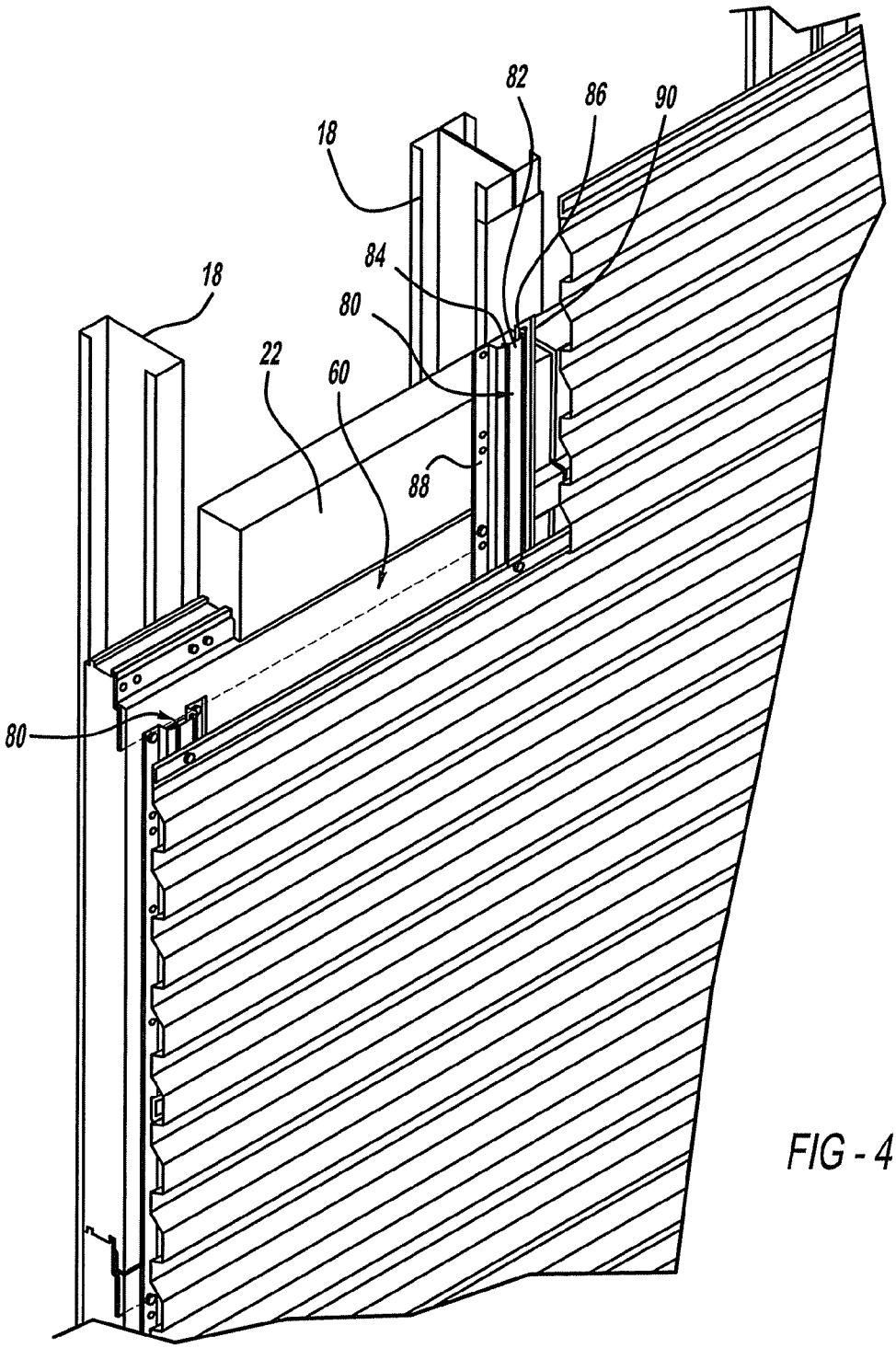
FIG. 4 is a perspective breakaway view of a second embodiment with the panels in a horizontal position.
Figure 5:
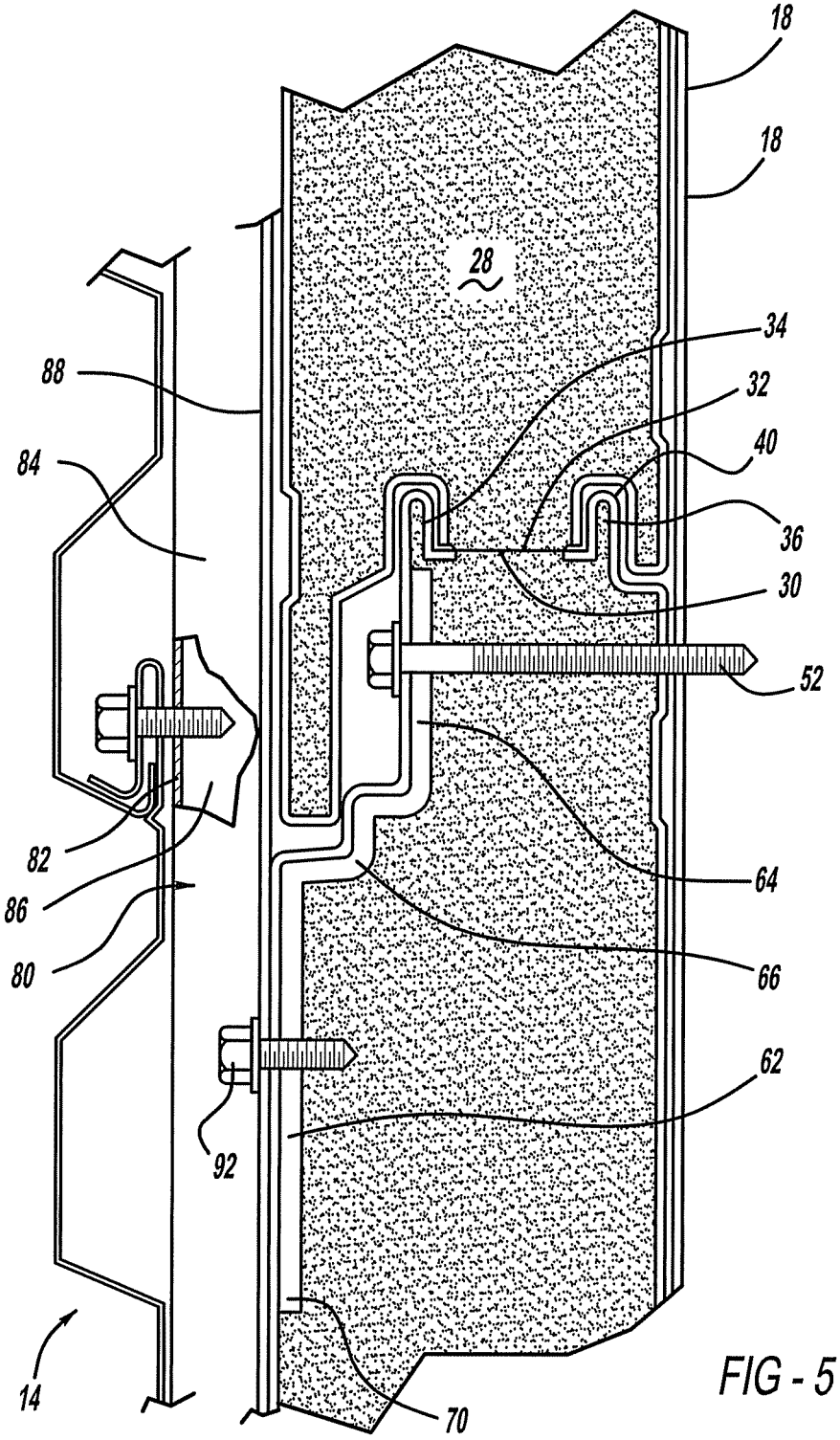
FIG. 5 is a cross-section view of FIG. 4 along line 4-4 thereof.

Turning to FIGS. 4 and 5, a second embodiment is illustrated. In this embodiment, those elements that are the same as previously discussed are designated with the same reference numeral. The difference between the first embodiment and the second embodiment lies in the fact that an additional frame member is secured with the internal rails 60 to enhance securement of the façade 14 to the wall panels.

Here, a frame member 80 is secured with the rail body 62 of the rail 60. The frame member 80 is an elongated member stamped to have desired shape when viewed in cross-section. The frame member 80 includes a web 82, legs 84, 86 and flanges 88, 90. The flanges 88, 90 receive fasteners 92 to secure the framing member 80 onto the body 62 of the rail 60. Here, the façade 14 is secured to the frame members 80.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A building wall panel comprising:

a metallic outer skin forming a front side of the building wall panel, the metallic outer skin having an outer skin front face, the outer skin front face having a contoured configuration portion;

a metallic inner skin forming a rear side of the building wall panel;

foam insulating material bonding with and positioned between the metallic outer skin and the metallic inner skin;

a pair of edges is formed on the panel between the front and rear sides, the edges interlock with corresponding edges of adjacent panels, the edges are positioned laterally or parallel to the ground;

a pair of sides is formed on the panel between the front and rear sides and between the pair of edges, the pair of sides are positioned longitudinally or perpendicular to the ground; and a rail having a rail contoured portion is positioned in the foam insulating material immediately adjacent the outer skin and near one of the pair of edges near the contoured configuration portion, the rail contoured portion is contoured to correspond to the contoured configuration portion, the rail is bonded to an inner side of the outer skin so that the contoured configuration portion and the rail contoured portion mesh with one another such that the foam insulating material is not present between the rail and inner side of the outer skin, the rail spans along the one edge of the front side of the panel from one side of the panel to the other side of the panel, the rail extends from the one edge along the inner side of the outer skin so that the rail receives fasteners that secure the building panel to a framing structure and the rail receives fasteners to secure a façade to the panel to provide an anchoring system for the façade.

2. The building panel of claim 1, wherein one of the pair of edges is a projecting edge and the other of the pair of edges is a receiving edge and the receiving edge including at least one step in the outer skin.

3. The building panel of claim 2, wherein the rail includes at least one step mating with the at least one step of the outer skin.

4. The building panel of claim 3, wherein the rail is adhered to an inner side of the outer skin.

5. The building panel of claim 1, wherein the rail is positioned only on the front side of the building panel.

6. The building wall panel of claim 1, wherein the rail is continuous along the one edge from one side of the panel to the other side of the panel.

7. A building comprising:

a frame structure, a wall system and a façade, the wall system including a plurality of panels, the plurality of panels are positioned adjacent one another for securement to a frame structure via fasteners;

each panel comprising:

a metallic outer skin forming a front side of the panel, the metallic outer skin having an outer skin front face, the outer skin front face having a contoured configuration portion;

a metallic inner skin forming a rear side of the panel;

foam insulating material bonding with and positioned between the metallic outer skin and the metallic inner skin;

a pair of edges formed on each panel between the front and rear sides, the edges interlock with corresponding edges of adjacent panels of the building, the edges are positioned laterally or parallel to the ground;

a pair of sides is formed on the panel between the front and rear sides and between the pair of edges, the pair of sides are positioned longitudinally or perpendicular to the ground;

a rail having a rail contoured portion is positioned in the foam insulating material immediately adjacent the outer skin and near one of the pair of edges near the contoured configuration portion, the rail contoured portion is contoured to correspond to the contoured configuration portion, the rail is bonded to an inner side of the outer skin so that the contoured configuration portion and the rail contoured portion mesh with one another such that the foam insulating material is not present between the rail and inner side of the outer skin, the rail spans along the one edge of the front side of the panel from one side of the panel to the other side of the panel, the rail extends from the one edge along the inner side of the outer skin so that the rail receives fasteners that secure the building panel to a framing structure and the rail receives fasteners to secure the façade to the panel to provide an anchoring system for the façade; and the façade provides an aesthetic appearance.

8. The building of claim 7, wherein one of the pair of edges is a projecting edge and the other of the pair of edges is a receiving edge and the receiving edge including at least one step in the outer skin.

9. The building of claim 8, wherein the rail includes at least one step mating with the at least one step of the outer skin.

10. The building of claim 9, wherein the rail is adhered to an inner side of the outer skin.

11. The building of claim 7, wherein the rail is positioned only on the front side of the building panel.

12. The building wall panel of claim 7, wherein the rail is continuous along the one edge from one side of the panel to the other side of the panel.

13. A building wall panel comprising:

a metallic outer skin forming a front side of the building wall panel, the metallic outer skin having an outer skin front face, the outer skin front face having a contoured configuration portion;

a metallic inner skin forming a rear side of the building wall panel;

foam insulating material bonding with and positioned between the metallic outer skin and the metallic inner skin;

a pair of edges is formed on the panel between the front and rear sides, the edges interlock with corresponding edges of adjacent panels, the edges are positioned laterally or parallel to the ground;

a pair of sides is formed on the panel between the front and rear sides and between the pair of edges, the pair of sides are positioned longitudinally or perpendicular to the ground; and a rail having a rail conoured portion is positioned in the foam insulating material immediately adjacent the outer skin and near one of the pair of edges near the contoured configuration portion, the rail contoured portion is contoured to correspond to the contoured configuration portion, the rail is bonded to an inner side of the outer skin so that the contoured configuration portion and the rail contoured portion mesh with one another such that the foam insulating material is not present between the rail and inner side of the outer skin, the rail spans along the one edge of the front side of the panel from one side of the panel to the other side of the panel, the rail extends from the one edge along the inner side of the outer skin so that the rail receives first fasteners that secure the building panel to a framing structure and the rail receives second fasteners to secure a façade to the panel to provide an anchoring system for the façade.

14. The building wall panel of claim 13, wherein the rail is continuous along the one edge from one side of the panel to the other side of the panel.

* * * * *